United States Patent [19]

Sutton

[11] 4,104,856

[45] Aug. 8, 1978

[54] CENTER SPACING GAUGE FOR FRICTION TWISTING UNITS

[75] Inventor: Theodore Leonard Sutton, Enka, N.C.

[73] Assignee: Akzona Incorporated, Asheville, N.C.

[21] Appl. No.: 797,941

[22] Filed: May 18, 1977

[51] Int. Cl.[2] ..... D01H 7/92; D01H 13/00

[52] U.S. Cl. ..... 57/77.4; 33/174 G; 33/180 R; 57/34 R

[58] Field of Search ..... 57/34 R, 77.4, 77.45, 57/112; 33/174 G, 180 R, 181 R

[56] References Cited

U.S. PATENT DOCUMENTS 3,885,378 5/1975 Schuster ..... 57/77.45

3,964,248 6/1976 Schuster ..... 57/77.4

*Primary Examiner*—Richard C. Queisser
*Assistant Examiner*—Charles Gorenstein
*Attorney, Agent, or Firm*—Craig & Antonelli

[57] ABSTRACT

A centering gauge arrangement for a yarn friction false twist device which includes a plurality of concavities or depressions spaced above the circumference of the gauge with the respective concavities or depressions being engageable with reference surfaces provided on parallel equiangularly spaced shafts of the yarn friction false twist device. A handle portion is provided on the centering gauge to facilitate a loading and unloading of the centering gauge from the yarn friction false twist device.

10 Claims, 3 Drawing Figures

CENTER SPACING GAUGE FOR FRICTION TWISTING UNITS

The present invention relates to a gauge construction and, more particularly, to a centering gauge construction for a yarn friction false twist device which includes a plurality of parallel equiangularly spaced rotary devices at least two of which are adjustable.

Yarn friction false twist devices have been proposed, for example, in U.S. Pat. No. 3,932,985, wherein three parallel, equiangularly spaced shafts are provided each of which includes axially spaced friction disks which overlap one another such that a strand of yarn passing through the center of the false twist device follows a zig-zag path. To permit the proposed false twist device to operate under optimum conditions for a yarn of a given denier and/or yarns of different deniers and/or other varying properties or characteristics, the axes of the spaced shafts, as well as the axial spacing of the disks, are adjustable.

To adjust the center spacing of the respective shafts, a centering gauge is interposed between a stationary shaft and two adjustable shafts with the centering gauge being configured so as to seat itself at the stationary shaft with the adjustable shafts then being brought into contact with a peripheral surface of the centering gauge and subsequently locked in position.

A centering gauge of the type described above is disclosed in the aforementioned United States Patent and consists of an annular semi-circular distance piece which is accurately made with the size of the distance piece being determined by the desired setting of the axes of the rotary devices in accordance with the particular deniers and/or other characteristics of the yarn to be processed.

In the above-noted conventional centering gauge, an inner concave side is provided which is adapted to be seated on a reference surface of the fixed rotary device with reference surfaces of the adjustable rotary devices then sequentially being brought into engagement with an outer convex side of the gauge.

One disadvantage of the known centering gauge resides in the fact that, by virtue of the provision of a single concave side which engages a reference surface of only one of the rotary devices, loading and unloading of the centering gauge is relatively difficult since the centering gauge is free to pivot about the fixed rotary device during a setting operation.

A further disadvantage of the known centering gauge resides in the fact that a premature exiting from the yarn friction false twist device is possible during a setting of the adjustable rotary devices.

A still further disadvantage of the conventional centering gauge resides in the fact that the setting time is considerable since the centering gauge is relatively freely movable about the fixed rotary device.

The aim underlying the present invention essentially resides in improving a centering gauge of the aforementioned type. For this purpose, the centering gauge is constructed so as to provide specifically configured areas adapted to be brought into engagement with reference areas on the respective rotary devices.

According to one advantageous feature of the present invention, the centering gauge is provided with at least three concavities or depressions spaced about the circumference of the gauge with the respective concavities being engageable with a fixed rotary device and the adjustable rotary devices.

According to another feature of the present invention, two of the concavities or depressions have a semi-circular configuration with the third concavity or depression having an arcuate configuration and terminating in a linear or flat surface of a predetermined length which adjoins an arcuate outer surface portion defining the outer periphery of the centering gauge between the third concavity or depression and one of the other concavities or depressions.

By virtue of the provision of the linear surface in accordance with the present invention, after a centering operation, the centering gauge is pivoted or rotated about one of the adjusted rotary devices to permit removal of the gauge from the adjusted false twist device.

According to yet a further feature of the present invention, a handle portion is provided on the centering gauge to facilitate a loading and unloading of the centering gauge from the yarn friction false twist device after a set-up operation.

Accordingly, it is an object of the present invention to provide a centering gauge which avoids by simple means the aforementioned drawbacks and disadvantages encountered in the prior art.

A further object of the present invention resides in providing a centering gauge which is simple in construction and, therefore, relatively inexpensive to manufacture.

Yet another object of the present invention resides in providing a centering gauge which ensures an accurate setting of the rotary devices in a minimum setting time.

These and other objects, features and advantages of the present invention will become more apparent from the following description when taken in connection with the accompanying drawings which show, for the purposes of illustration only, one embodiment in accordance with the present invention, and wherein.

Figure 1:
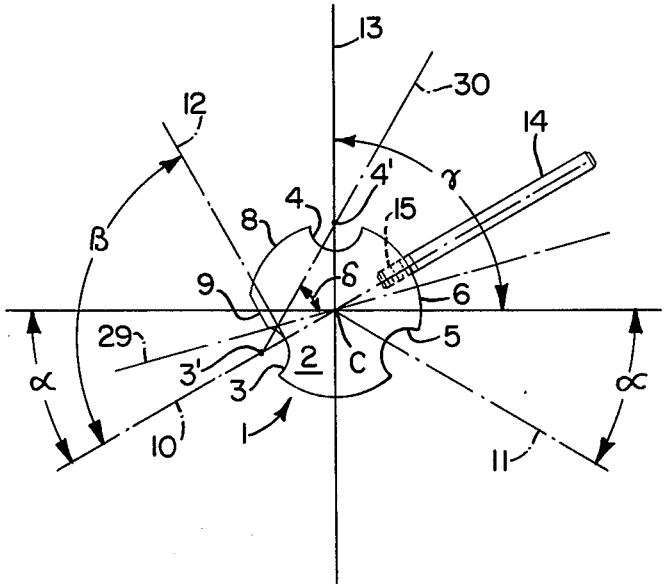
FIG. 1 is a plan view of a centering gauge in accordance with the present invention.

Referring now to the drawings wherein like reference numerals are used throughout the various views to designate like parts and, more particularly, to FIG. 1, according to this figure, a centering gauge generally designated by the reference numeral 1 includes a main body portion 2 having three concavities or depressions 3, 4, 5 spaced about the periphery of the body portion 2. Arcuate surface portions 6, 7 extend between the concavities 4, 5 and 3, 5, respectively. The concavities 4, 5 are substantially semi-circular in configuration with the concavity 3 being arcuate and terminating in a linear or flat surface 9 adjoining an arcuate surface portion 8 defining the periphery of the main body portion 2 between the end surface 9 and the concavity 4. The provision of the linear of flat surface 9 facilitates the removal of the centering gauge 1 after an adjusting operation in a manner described more fully hereinbelow.

The concavities 3, 5 are arranged such that radial lines 10, 11 extending through the respective centers of the concavities 3, 5 and the center C of the body portion 2 subtend with a horizontal center line extending through the center of the body portion 2 an angle $\alpha$ which, in the illustrated embodiment, is equal to 30°.

The radial line 10 subtends with a line 12 extending tangential to the bottom of the concavity 3 an angle $\beta$ which, in the illustrated embodiment, is equal to 90°. The concavities 4, 5 are arranged with respect to each other such that a radial line 13 extending through the center of the concavity 4 and the center C of the body portion subtends with a horizontal center line an angle $\gamma$ which, in the illustrated embodiment, is equal to 90°.

The arcuate length of the concavity or depression 3 is such that a line 29 passing through the end point of the linear or flat surface 9 tangent to the concavity 3 at that point subtends with a line 30 extending between the centers 3', 4' an angle $\delta$ opening toward the center C of the body portion 2. Preferably, the angle $\delta$ is equal to 30°.

A handle 14 is provided with a threaded end portion which is receivable in a threaded bore 15 with the handle being arranged between the concavities 4, 5 and, in the illustrated embodiment, along an extension of the radial line 10.

Figure 2:
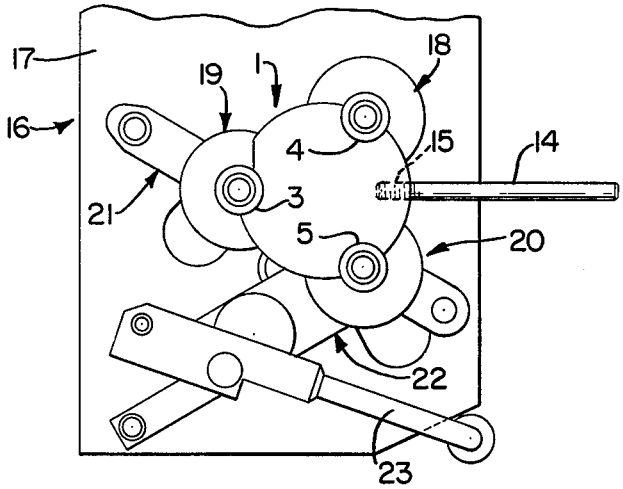
FIG. 2 is a plan view of the centering gauge of FIG. 1 arranged in a yarn friction false twist device.

As shown in FIG. 2, a yarn friction false twist device generally designated by the reference numeral 16 includes a base plate 17 having mounted thereon a relatively fixed shaft generally designated by the reference numeral 18 having a first set of disks arranged thereon. Second and third sets of adjustable disks are respectively arranged on two further shafts generally designated by the reference numerals 19 and 20 mounted on arms 21, 22 pivotally mounted on the base plate 17. An adjusting and/or locking handle 23 is provided for facilitating the pivotal displacement of the pivot arm 22 and a further adjusting handle (not shown) may be provided for the pivot arm 21 to facilitate an adjustment and/or locking thereof.

Figure 3:
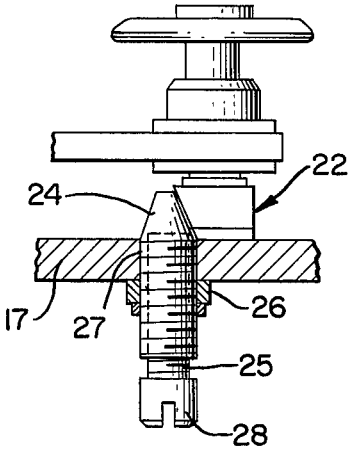
FIG. 3 is a partial cross-sectional view on an enlarged scale of an adjusting arrangement for one of the shafts of the yarn twisting device of FIG. 2.

As shown in FIG. 3, an adjusting screw arrangement is provided which includes an adjusting screw 25 threadably receivable in a locking collar 26 which, in turn, is threadably received in a bore 27 provided in the base plate 17. The adjusting screw 25 is provided at one end with a slotted head 28 or the like for accommodating an adjusting tool. The other end of the adjusting screw 25 is provided with a conical adjusting surface portion 24 which is engageable with a machined surface of the pivot arm 22. As readily apparent from FIG. 2, upon an adjustment of the screw 25, the conical adjusting surface portion 24 causes a fine adjustment of the pivot arm 22.

To set up the yarn friction false twisting device, the individual shafts 19, 20 are displaced to an open position by pivoting the adjusting and/or locking handle 23 in a clockwise direction, turning the adjustment screw 25 in a counterclockwise direction until only the conical adjusting surface portion 24 is exposed and loosening a fastener such as a cap screw or the like (not shown) securing the adjustable pivot arm 21. The pivot arm 21 is displaced to an extreme clockwise position and secured thereat by the cap screw and the setting gauge 1 is inserted between the shafts 18, 19, 20 and is rotated into position by using a surface of the fixed shaft 18 as a pivot point. The pivot arm 22 is then displaced by pivoting the handle 23 in a counterclockwise direction so as to bring a reference surface of the shaft 20 into engagement with the concavity 5. The cap screw is once again loosened so as to permit the pivot arm 21 to be displaced into position with a reference surface of the shaft 19 coming into engagement with the concavity 3. The cap screw is once again fastened to secure the pivot arm 21 in its adjusted position and the screw 25 is turned clockwise until the conical adjusting surface portion 24 contacts the surface of the pivot arm whereat the screw 25 is secured in the adjusted position by the locking collar 26. After the individual shafts 18, 19, 20 have been adjusted, the handle 23 is once again pivoted in a clockwise direction displacing shaft 20 therewith. The centering gauge 1 is then rotated around the fixed shaft 18, which rotation is facilitated by the provision of the flat or linear surface 9, thereby permitting removal of the centering gauge 1. Subsequently, the adjusting and/or locking handle 23 is then displaced to a locked position and the set up of the yarn friction false twist device is completed.

While I have shown and described only one embodiment in accordance with the present invention, it is understood that the same is not limited thereto, but is susceptible of numerous changes and modifications as known to one skilled in the art, and I therefor do not wish to be limited to the details shown and described herein, but intend to cover all such changes and modifications as are encompassed by the scope of the appended claims.

I claim:

1. In a yarn friction false twist device which includes at least three parallel equiangularly spaced shafts each of which has arranged thereon a plurality of rotatable disks, the improvement comprising a gauge means for center spacing of the shafts, said gauge means including a main body portion and a plurality of means disposed about the periphery of the body portion for engaging a reference surface of the respective shafts so as to adjust said shafts at a predetermined distance with respect to each other, said engaging means including at least three depressions spaced about the periphery of the body portion, at least two of said depressions having a semicircular configuration and the third of said depressions having an obtuse arcuate configuration; and said main body portion including a convex outer surface portion disposed between said at least two depressions and a linear surface portion adjoining the third depression and a convex outer surface portion arranged between said linear surface portion and one of the at least two depressions.

2. The gauge means of claim 1, wherein said main body portion includes a further convex outer surface portion arranged between the third depression and the other of said at least two depressions.

3. The gauge means of claim 2, wherein means are provided at said body portion for facilitating the insertion and aligning of the centering gauge means.

4. In a yarn friction false twist device which includes at least three parallel equiangularly spaced shafts each of which has arranged thereon a plurality of rotatable disks, the improvement comprising a gauge means for center spacing of the shafts, said gauge means including main body portion and a plurality of means disposed about the periphery of the body portion for engaging a reference surface of the respective shafts so as to adjust said shafts at a predetermined distance with respect to each other, said engaging means including at least three depressions spaced about the periphery of the body portion, one of said depressions having an obtuse arcuate configuration, and said main body portion including a linear surface portion adjoining said last-mentioned depression and a convex outer surface portion adjoining said linear surface portion and extending therefrom to another of said depressions.

5. The gauge means of claim 4, wherein a line passing through an end point of said linear surface portion at said one of said depressions tangent to said last-mentioned depression subtends with a line extending between centers of said one depression and said another depression an angle of approximately 30° opening toward a center of said main body portion.

6. The gauge means of claim 4 wherein means are provided at said main body portion for facilitating the insertion and aligning of the centering gauge means.

7. In a yarn friction false twist device which includes at least three parallel equiangularly spaced shafts each of which has arranged thereon a plurality of rotatable disks, the improvement comprising a gauge means for center spacing of the shafts, said gauge means including a main body portion and a plurality of means disposed about the periphery of the body portion for engaging a reference surface of the respective shafts so as to adjust said shafts at a predetermined distance with respect to each other, said main body portion including a convex outer surface portion disposed between at least two of said engaging means and a linear surface portion adjoining another of said plurality of engaging means and a convex surface portion adjoining said linear surface portion disposed between said another engaging means and one of said a least two engaging means.

8. The gauge of claim 7, wherein means are provided at said main body portion for facilitating the insertion and aligning of the centering gauge means.

9. In combination with a yarn friction false twist device which includes at least three parallel equiangularly spaced shafts each of which has arranged thereon a plurality of rotatable disks, a gauge means for center spacing of the shafts, said gauge means including a main body portion and a plurality of means disposed about the periphery of the body portion for engaging a reference surface of the respective shafts so as to adjust said shafts at a predetermined distance with respect to each other, said main body portion including a linear surface portion adjoining one of said plurality of said engaging means and a convex surface portion adjoining said linear surface portion disposed between said one of said engaging means and another of said engaging means disposed about the periphery of the body portion.

10. A center spacing gauge for a yarn friction false twist device, which device includes at least three parallel equiangularly spaced shafts each of which has arranged thereon a plurality of rotatable disks, said gauge facilitating the center spacing of the shafts of said false twist device and comprising a main body portion and a plurality of means disposed about the periphery of the body portion for engaging a reference surface of the respective shafts of the false twist device so as to adjust said shafts at a predetermined distance with respect to each other, said main body portion including a linear surface portion adjoining one of said plurality of engaging means and a convex surface portion adjoining said linear surface portion disposed between said one engaging means and another of said plurality of engaging means disposed about the periphery of said body portion.

* * * * *